United States Patent [19]

Munroe et al.

[11] Patent Number: 4,613,197

[45] Date of Patent: Sep. 23, 1986

[54] RAPID ASSEMBLY ELECTRICAL PLUG

[75] Inventors: Ronald G. Munroe, Staten Island; Gregory E. Moreinis, Forest Hills, both of N.Y.

[73] Assignee: Eagle Electric Mfg. Co., Inc., Long Island City, N.Y.

[21] Appl. No.: 747,712

[22] Filed: Jun. 24, 1985

[51] Int. Cl.[4] ..... H01R 4/24

[52] U.S. Cl. ..... 339/99 R; 339/100

[58] Field of Search ..... 339/97 R, 97 P, 98, 339/99 R, 100

[56] References Cited

U.S. PATENT DOCUMENTS 2,682,647 6/1954 Smith ..... 339/99 R 4,360,242 11/1982 Poliak ..... 339/99 R

*Primary Examiner*—Joseph H. McGlynn

*Attorney, Agent, or Firm*—Kirschstein, Kirschstein, Ottinger & Israel

[57] ABSTRACT

A rapid assembly electrical plug includes a main body which bounds a receiving channel for the end portion of an electrical cord and partially bounds an input opening, and a lid which is mounted on the main body for movement between its open and closed positions transversely with respect to the receiving channel and completes the bounding of the input opening in its closed position. Electrical contact prongs are mounted in the main body of the plug housing and include respective side penetrating portions which penetrate into the cord substantially transversely thereof at the region of merger of the input opening with the receiving channel, and end penetrating portions which penetrate into the electrical conductors of the cord substantially in the longitudinal direction of the cord and from the free end of the latter at the bottom of the receiving channel. The input opening extends toward the receiving channel along a course having several bends to deform the cord accordingly to improve the retention of the cord in the plug housing. The side penetrating portions have flat surfaces which contact the electrical conductors of the cord and press the latter against the cord jacket portions to press the latter against the plug housing, thus further improving the retention of the cord in the plug housing. By using central grooves in wire for centralization, this device is designed for use with two types of wire insulation thicknesses.

18 Claims, 7 Drawing Figures

RAPID ASSEMBLY ELECTRICAL PLUG

BACKGROUND OF THE INVENTION

The present invention relates to electrical connecting arrangements in general and, more particularly, to an electrical plug which is to be mounted on and electrically connected to a free end portion of an electrical cord and is intended to be inserted into an electrical receptacle.

There are already known various constructions of electrical plugs of the above type. A persistent problem in this field is the possibility that the electrical wires of the cord could become loose from their mountings in the plug and create an electrical shock hazard or poor contact and subsequent overheating. To avoid this problem, many plugs are permanently mounted on the cords, that is, the contact-establishing prongs and the mountings of the cord wires to such prongs are permanently encased in a plug housing which is molded around portions of such prongs and the mountings.

However, in many instances, it is required to attach a plug to a cord in situ, without having to replace the entire cord/plug combination, for instance, after the plug has become damaged or inoperative for any reason. Under these circumstances, it is necessary to have available an electrical plug which is separate from any cord but which can be rather easily assembled with the cord on location and will establish a good electrical connection with the cord electrical conductors and be safe in use.

A potential problem in this area is the relatively high forces which may be applied to the cord during the use thereof, for instance, when the user attempts to remove the plug from the receptacle by pulling on the cord, rather than by engaging the plug housing and pulling on the latter. Even though such a practice has been denounced by the manufacturers of electrical equipment and by various safety agencies, it is still being used and hence this possibility cannot be discounted. When this happens, the cord can be subjected to a force of 30 lbs. or more, and this force attempts to extract the cord from the housing.

Various approaches have been proposed to keep the end portion of the cord in the housing despite the application of such rather high extraction forces to the cord, including various clamping arrangements and even arrangements which penetrate or dig into the cord in the transverse direction thereof to resist the extraction force and thus to keep the cord end portion in position in the interior of the plug housing.

It is also important that the electrical connection between the prongs and the respective electrical conductors of the cord be as good as possible, so as to avoid electric sparks or high resistance at the interface between the prongs and the electrical conductors, with attendant danger of damage to the electrical plug. For this reason, it has already been proposed to use piercing or penetrating elements which are in many instances of one piece with the respective prongs and which penetrate into the electrical conductors either transversely of the cord, through the insulating jacket portions of the latter, or from the free end of the cord, substantially in the longitudinal direction of the cord. Obviously, the end penetrating elements have no retaining capability for the cord, but do make better electrical contact. The side penetrating elements do a better job of retaining the cord in the plug housing, since they are so configurated, consistently with their function, as to achieve the best hold but make poorer electrical contact. Because of this, the side penetrating elements usually do possess sufficient retaining capability to maintain the cord in the plug housing, but do not make adequate electrical contact, especially after a long duration of current cycling.

SUMMARY OF THE INVENTION

Accordingly, it is a general object of the present invention to avoid the disadvantages of the prior art.

More particularly, it is an object of the present invention to provide an electrical connecting arrangement, especially an electrical plug, which does not possess the disadvantages of the conventional arrangements of this type.

Still another object of the present invention is so to construct the electrical connecting arrangement of the type here under consideration as to be able to achieve an excellent electrical contact with the electrical conductors of a cord in which it is mounted, and also achieve superb mechanical retention on the electrical cord.

It is yet an additional object of the present invention to enable the electrical plug to efficiently accept more than one wire size, e.g. SPT-1 and SPT-2 wire.

It is yet another object of the present invention so to design the arrangement of the above type as to be able to rapidly and easily connect the same to, and disconnect the same from, the electrical cord.

A concomitant object of the present invention is to develop an arrangement of the above type which is simple in construction, inexpensive to manufacture, easy to use, and reliable in operation nevertheless.

In pursuance of these objects and others which will become apparent hereafter, one feature of the present invention resides in an electrical connector which comprises a housing bounding an input opening and a receiving channel for an end portion of an electrical cord having at least two electrical conductors surrounded by respective insulating jacket portions; at least two electrical contact elements mounted in position in said housing and operative for establishing electrical contacts with their respective counterparts; and means for establishing electrical connections between the respective electrical conductors of the electrical cord and the associated electrical contact elements. According to the present invention, such establishing means includes end penetrating elements electrically connected to the respective electrical contact elements and mounted in the housing at such locations as to project into the respective electrical conductors in the longitudinal direction of the cord during the introduction of the end portion of the cord into the receiving channel, and side penetrating elements also electrically connected to the respective electrical contact elements and so mounted in and positioned with respect to the housing as to penetrate through the jacket portions of the cord and into electrical contact with the respective electrical conductors in the input opening and substantially transversely of the electrical cord. A particular advantage of this arrangement is that the main electrical contact between the electrical contact elements and the respective electric conductors of the cord is established by the respective end penetrating elements, so that the side penetrating elements, if at all, serve only as a backup for the end penetrating elements as far as their electrical properties are concerned. This means that the side penetrating elements can be designed with the main function of preventing extraction of the cord from the plug housing in mind.

In this respect, it is particularly advantageous when the end penetrating elements and the side penetrating elements are of one piece with the respective contact elements to form respective regions thereof. It is further advantageous when each of the side penetrating elements has at least a zone with a flat contact surface which presses against the associated electrical conductor without penetrating into the same to locally displace the electrical conductor and press the same against the oppositely located zone of the jacket portion that is juxtaposed with a portion of the housing to deform such zone and increase the frictional retention of the same with respect to the housing.

To further improve the retaining capability of the side penetrating elements, each of the side penetrating elements advantageously has an arcuate configuration that is bent oppositely to the direction of extraction of the end portion of the cord out of the input opening to resist such extraction.

According to another advantageous concept of the present invention, the housing include a main body which bounds the receiving channel and partially delimits the input opening, and a lid mounted on the main body and completing the delimitation of the input opening in its mounted position, the input opening and the receiving channel following a tortuous course in the housing with a plurality of bends. In this context, it is advantageous when the input opening extends, at the region at which the end portion of the cord enters the housing, substantially normal to the receiving channel, when the input opening further starts to slope toward the receiving channel shortly after the entry region of the cord, and when the slope of the input opening terminates short of the receiving channel and the input opening has a section at the region of merger thereof with the receiving channel which extends substantially normal to the receiving channel. Then, it is advantageous to situate the side penetrating elements at this section of the input opening.

According to another aspect of the present invention, the housing includes respective walls which bound the input opening and the receiving channel, at least some of such walls being elastically yieldable to aid in the retention of the end portion of the cord in the input opening and the receiving channel, and to properly centralize a smaller and a larger cord size.

It is further advantageous when the aforementioned lid of the housing is mounted on the main body of the housing for movement along the input opening between its open and closed position, the lid completing the delimitation of the input opening in its closed position. The main body of the housing advantageously includes a stop and the lid has a nose which engages behind the stop in the closed position of the lid to maintain the lid in such closed position. In this respect, it is advantageous when at least the lid is elastically yieldable, and when the housing has a tool-receiving recess at the interface between the lid and the main body at the region of the stop and of the nose for the insertion of a tool thereinto for elastically deflecting the lid at this region and thus disengaging the nose from the stop for releasing the lid for movement toward the open position thereof.

Another advantageous facet of the present invention resides in the provision of a depression on one of the main body and lid, and a projection on the other, this projection being received in the depression in the open position of the lid to temporarily maintain the lid in the open position thereof.

The main portion of the housing advantageously includes two confining wall portions which are situated at the opposite sides of the input opening and have wedge-shaped configurations to enclose an obtuse angle with the receiving channel. Then, the lid has at least one receiving space which receives the confining wall portions at least in the closed position of the lid and has a shape compatible to the wedge-shaped configurations of the confining wall portions. Also, the squeezing action of the lid on the top of the cord helps to hold the cord in place against any external pulls.

The novel features which are considered as characteristic of the invention are set forth in particular in the appended claims. The improved rapid assembly electrical plug itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
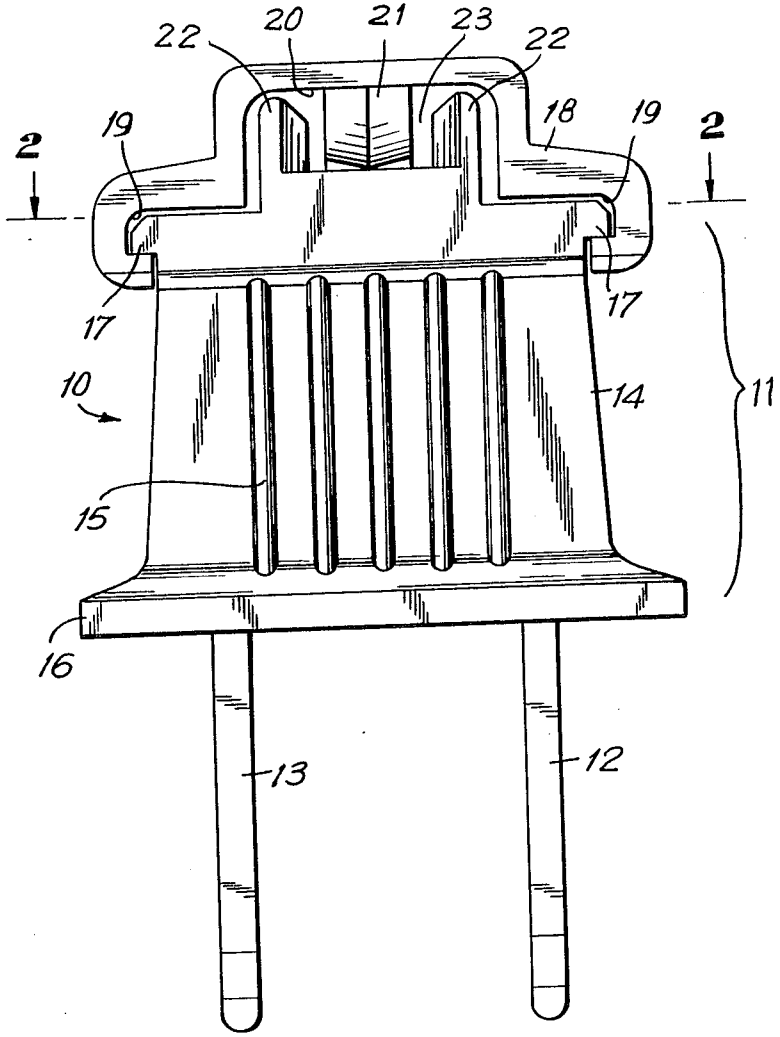
FIG. 1 is a considerably enlarged side elevational view of the electrical plug constructed in accordance with the present invention.

Referring now to the drawing in detail, and first to FIG. 1 thereof, it may be seen that the reference numeral 10 has been used therein to identify an electrical plug of the present invention in its entirety. The electrical plug 10 includes, as its main components, an electrically insulating housing 11 and two electrically conductive prongs 12 and 13. As will be described in detail later, the two prongs 12 and 13 are so mounted in the housing 11 as to be electrically insulated from one another. As is well known, the prongs 12 and 13 serve for establishing electrical connections with corresponding contact elements provided in an electrical outlet receptacle. Neither the receptacle nor the contact elements of the same are shown in the drawing, since they are not necessary for understanding the present invention, are of well known constructions and arrangements with respect to one another, and their inclusion would unnecessarily encumber the drawing. The configurations of those portions of the prongs 12 and 13 which project to the exterior of the housing 11 are also well known, being of the type which permits the insertion of the prongs 12 and 13 into corresponding slots of the electrical outlet receptacle in only one orientation, thus assuring that the once selected polarity will be always maintained.

The housing 11 includes a main body 14 which has at its exterior a plurality of decorative ribs 15 and an end flange 16 at one of its ends, that is, at that end thereof beyond which the prongs 12 and 13 extend. At its other end remote from the outwardly projecting portions of the prongs 12 and 13, the housing 11 is provided with two guiding protuberances 17 that are shown to be arranged at opposite sides of the plug housing 11 as considered with respect to a central plane that bisects the plug 10 intermediate the prongs 12 and 13. The plug housing 11 further includes a lid 18 which has two guiding recesses 19 that receive the respective guiding protuberances 17 for guiding the lid 18 for movement relative to the main body 14 of the plug housing 11 in directions parallel to those of the guiding protuberances or ribs 17, that is, parallel to the aforementioned central plane. The lid 18 bounds an input recess 20 into which there extends a deviating rib 21 of the lid 18. In the assembled condition of the lid 18 with the main body 14 of the plug housing 11, the inlet recess 20 receives two confining projections 22 of the main body 14 which extend in a direction opposite to that of the prongs 12 and 13 beyond the remainder of the main body 14 at a portion of the latter which carries the guiding projections or ribs 17. The confining projections 22 delimit an input opening 23 between themselves.

Figure 2:
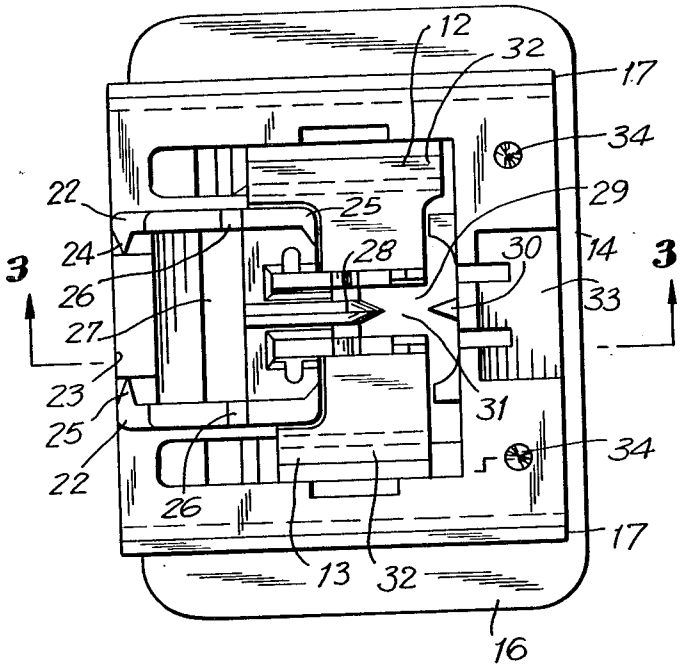
FIG. 2 is an end view of the electrical plug of FIG. 1, at an even more enlarged scale, taken on line 2—2 of FIG. 1 after a lid has been removed from the plug housing.

Turning now to FIG. 2 of the drawing, in which the main portion 14 of the plug housing 11 is shown after the removal of the lid 18 therefrom, it may be seen that the confining projections 22 have respective contact portions 24 and 25 which taper or converge to respective edges into the input opening 23. Each of the confining projections 22 has, substantially at the central longitudinal region thereof, a cutout or slot 26 which influences the deformation characteristic of the respective confining projections 22. The confining projections 22 are interconnected with one another, and held at a predetermined distance from each other, by a bridging portion 27 which also partially delimits the input opening 23 at a region that is remote from the lid 18 in the assembled condition of the plug housing 11. The bridging portion 27 carries, integrally therewith, a separating blade portion 28 which extends along the aforementioned central plane into a receiving channel 29 provided in the main body 14 of the plug housing 11. Another separating blade portion 30, which is integral with the main portion or body 14 of the plug housing 11, projects into the receiving channel 29 from the opposite zone and in substantial alignment with the blade portion 28. Together, the blade portions 28 and 30 bound a central gap 31 in the receiving channel 29. The confining projections 22, the bridging portion 27, and the blade portion 28 form a separating unit which is of an insulating material and preferably of the same material as the main portion 14 of the plug housing 11. As currently preferred, this separating unit 22, 27 and 28 is integral with the remainder of the main body 14 of the plug housing 11 and is formed during injection molding of the latter from a synthetic plastic material. FIG. 2 also reveals that the prongs 12 and 13 include portions 32 which are situated in the interior of the main body 14 of the plug housing 11 so as to be acccessible thereat. The details of the configuration of the portions 32 of the prongs 12 and 13, as well as the reasons for such configuration and the functions performed by the various zones thereof will become apparent later in the course of the present description. As may further be seen in FIG. 2, the main body 14 of the plug housing has a centrally located tool-receiving recess 33, and two detaining dents 34 which flank the recess 33.

Figure 3:
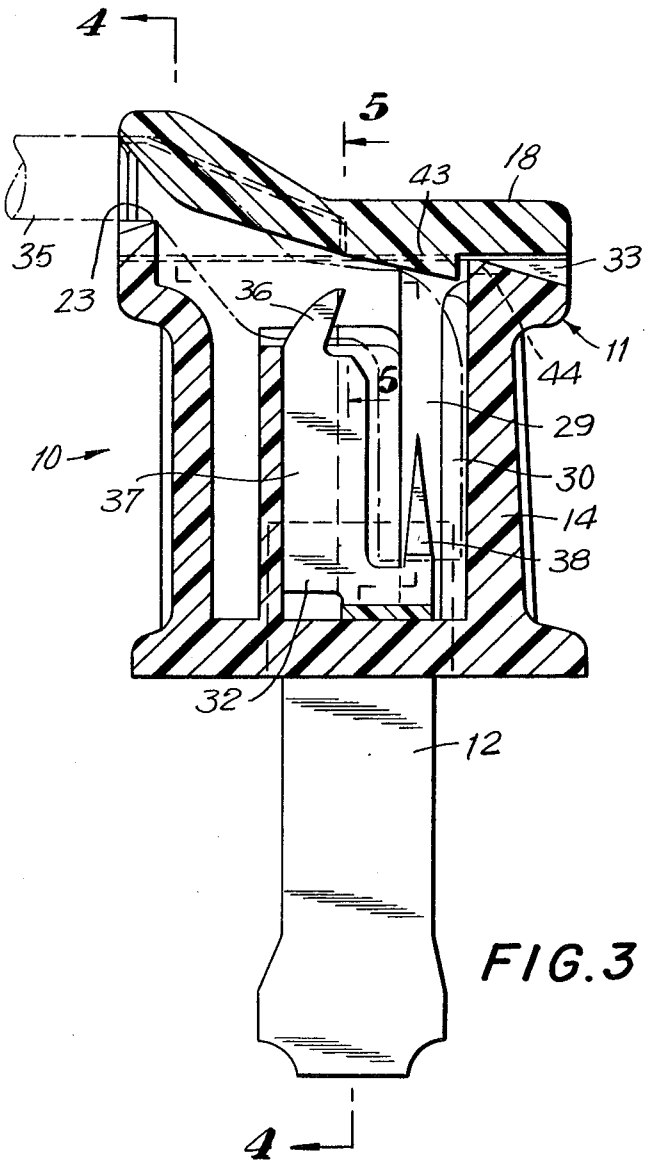
FIG. 3 is a sectional view taken on line 3—3 of FIG. 2, at a scale substantially corresponding to that of FIG. 1.

As illustrated in FIG. 3 where the plug housing 11 is shown in its fully assembled condition, that is, with the lid 18 mounted on the main body 14 in its closed position, the input opening 23 and the receiving channel 29 are intended to accommodate the end portion of an electrical cord 35 which is shown only in phantom lines to improve visibility. It may also be seen there that the inlet opening 23, after commencing substantially normal to the receiving channel 29, slopes down toward the receiving channel 29 as considered in the drawing. This means that the end portion of the electrical cord 35 has to follow a rather tortuous path in the interior of the plug housing 11, that is, it is forced to change its direction several times: first, it enters the input opening 23 substantially normal to the receiving channel 29, then it follows the sloping course of the input opening 23 toward but short of the receiving channel 29, then it changes its direction to be again substantially normal to the receiving channel 23 while still in the input opening 23, and finally it is bent through substantially 90° to enter and proceed through the receiving channel 29. This improves the retention of the end portion of the electrical cord or cable 35 in the interior of the plug housing 11.

This effect is further enhanced by providing the inside portions 32 of the prongs 12 and 13 with respective detaining regions 36 which are provided on respective holding regions 37 of the prongs 12 and 13. The detaining regions 36 penetrate into the electrical cord 35 substantially at a zone at which the cord 35 changes direction in the interior of the input opening 23. Each of the detaining regions 36 is sharpened to a degree necessary for it to be able to penetrate to the desired depth into the cord 35, and is bent backwardly to resist extraction of the end portion of the electric cord 35 out of the plug housing 11. Obviously, the lid 18 in the closed position thereof as illustrated in FIG. 3 of the drawing is configurated to force the end portion of the electric cord 35 to follow the aforementioned tortuous course within the input opening 23 and thus also presses the respective zones of the cord 35 that are juxtaposed with the detaining regions 36 against the latter, resulting in the initial penetration of the detaining regions 36 into the electric cord 35 and in maintenance of the detaining regions in the cord 35 after the initial penetration and while the lid 18 stays in its closed position. This, of course, means that the lid 18 has to be forced into its closed position while following the guiding projections or ribs 17 to actually press the electric cord 35 into its proper position in the input opening 23 and against the detaining regions 36, which makes it difficult to disassemble the lid 18 from the main body 14 when desired. To this end, the tool-receiving recess 33 permits the insertion of a tool, such as a screwdriver, between the main body 14 and the lid 18 of the plug housing 11, resulting in slight deformation of the lid 18 sufficient to allow the lid 18 to clear the cord 35 on its way toward its open position.

FIG. 3 of the drawing also reveals that the respective portion 32 of the respective prong 12 or 13 carries an end-penetrating region or spike 38 which, during and after the introduction of the end portion of the electric cord 35 into the receiving channel 29, penetrates into the electric cord 35 and establishes electric contact with the respective electric conductor thereof. Even though the respective detaining portion 36 also penetrates into the electric cord 35 and establishes electric contact with the respective electric conductor of the electric cord 35, this electrical contact is only secondary and the primary contact is established by the respective end-penetrating spike 38.

Figure 4:
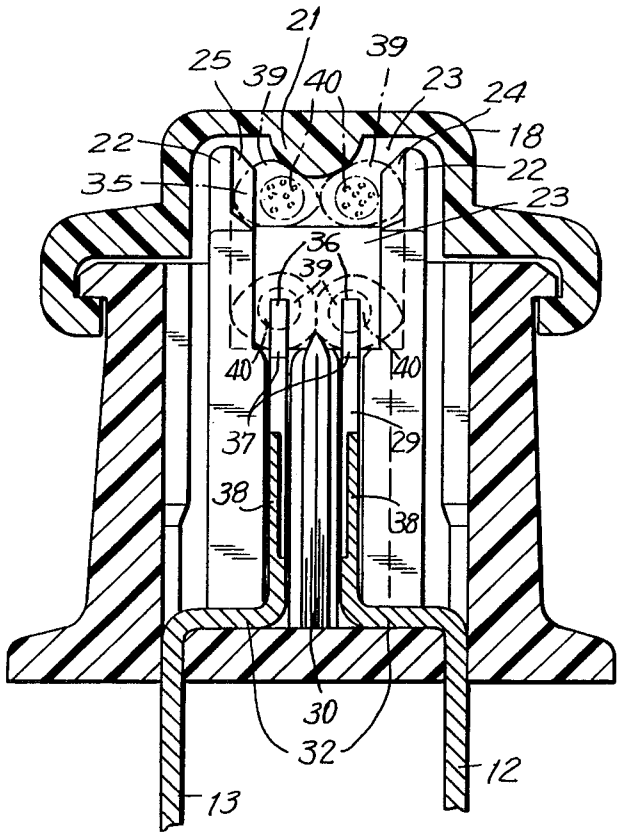
FIG. 4 is another sectional view, this time taken on line 4—4 of FIG. 3, with the scale thereof substantially corresponding to that of FIG. 1.

As depicted in FIG. 4 of the drawing, the prongs 12 and 13, inclusive of the inside portions 32 thereof, are basically of the same thickness, except that they are locally coined or otherwise deformed at the regions of the spikes 38 and/or at the detaining regions 36 thereof to facilitate the penetration of such regions into the electrical cord 35. It may also be seen here that the contact portions 24,25 of the confining projections 22 are pressed into respective elastic outer jacket portions 39 which surround respective electric conductors 40 of the cord 35, and that the deviating rib 21 of the lid 18 penetrates between the two jacket portions 39 and thus presses the electric cord 35 down as considered in the drawing to cause the latter to follow the sloping course thereof through the input opening 23. Then, at a location closer to the receiving channel 29, the detaining portions or regions 36 of the inside portions 32 of the respective prongs 12 and 13 are shown to penetrate through the respective outer jacket portions 39 and into the conductors 40.

Figure 5:
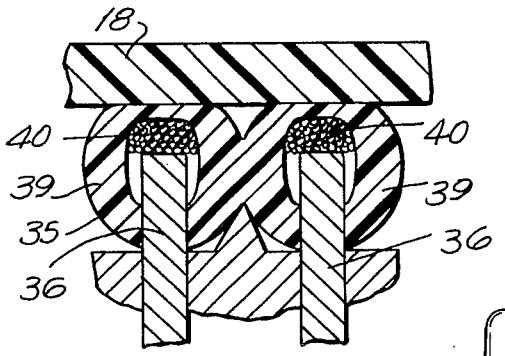
FIG. 5 is a detail view taken on line 5—5 of FIG. 3 and showing details of penetration of side-piercing portions of the prongs into the electrical cord.

As best seen in FIG. 5 of the drawing, the penetration of the inside portions 32 of the respective prongs 12 and 13 into the cable or cord 35 is incomplete at the zone at which the detaining portions or regions 36 have pierced the outer jacket portions 39, in that at least the holding portions or regions 37, if not the detaining regions 36, are provided with flat end faces so that, after penetrating fully through the outer jacket portions 39 of the cord 35, such regions merely displace rather than penetrate into the multi-wire electric conductors 40, due to the flat configuration of the end faces thereof. Consequently, the thus displaced electric conductors 40 compress the zones of the respective outer jacket portions 39 which are situated between such conductors 40 and the lid 18, thus providing an additional measure of retention of the end portion of the electric cord 35 in the interior of the plug housing 11 and particularly in the input opening 23 thereof.

Figure 6:
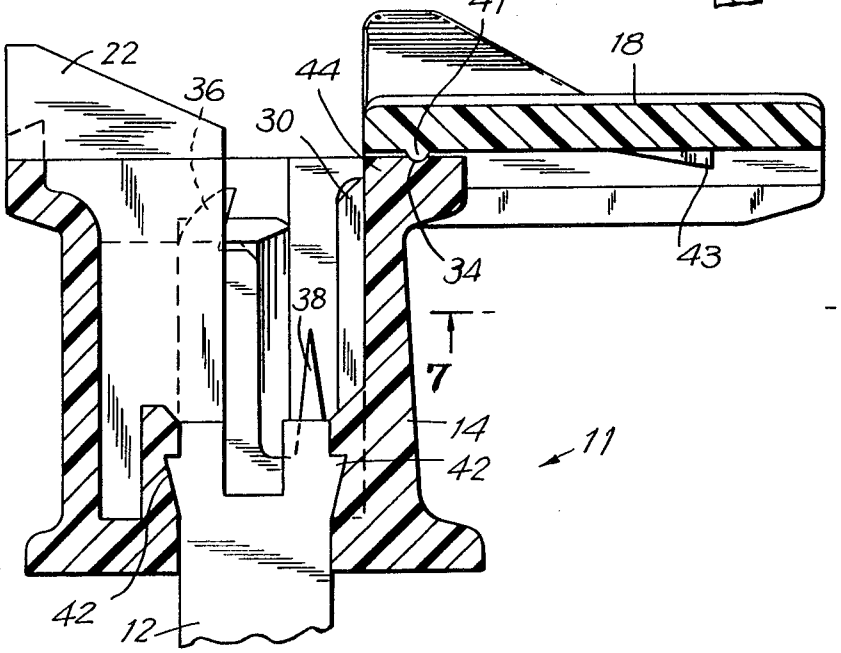
FIG. 6 is a view similar to FIG. 3 but showing the lid of the plug housing in its open position.

Referring now to FIG. 6 of the drawing, it may be seen that the housing 11 is shown therein in its assembled condition prior to the introduction of the cord 35 thereinto and with the lid 18 in its open position. As a comparison of FIGS. 6 and 7 with one another will reveal, the lid 18 is temporarily retained in this open position thereof, for instance, during transportation, store display and storage thereof, by means of two detaining protuberances 41 which are received in this open position of the lid 18 in the detaining dents 34. Yet, the retaining action of these protuberances 41 can be rather easily overcome when it is desired to displace the lid 18 toward its closed position, and the protuberances 41 clear the main body 14 of the plug housing 11 after traversing only a relatively small distance in the closing direction of the lid 18, and thereafter do not interfere with the movement of the lid 18 towards its closing position at all. It may also be seen in FIG. 6 that the prongs 12 and 13 are provided with respective barbs 42 which are embedded in the material of the main body 14 of the plug housing and thus prevent extraction of the prongs 12 and 13 from the housing 11.

The housing 11 is shown to be made of a synthetic plastic material which is preferably limitedly elastic to permit yielding of various portions thereof during the introduction of the cord 35 and during the closing of the lid 18. However, the yieldability of the material of the housing 11 is lower than that of the jacket portions 39 of the cord 35, so that the jacket portions 39 will yield before, and/or to a greater degree than, the housing 11 at those regions at which they are pressed against one another. In any event, the yieldability of the material of the housing 11 permits the latter to accommodate itself to the respective cord 35, particularly during the displacement of the lid 18 toward its closing position. This is important for assuring that the cord 35 is properly received and retained in the interior of the housing 11 and prevented from being extracted by a rather substantial pulling force of at least 35 lbs. that is applied to the cord 35. Such resistance to extraction is needed since often the user will pull on the cord 35 in order to remove the plug 10 from the electric outlet receptacle, even though such action is not recommended, and the connection of the cord 35 to the housing 11 must withstand even such improper handling. Therefore, the side penetrating detaining regions 36 of the prongs 12 and 13 are arcuately shaped, the bend of this arcuate configuration being oriented in opposition to the extraction direction. The tortuous path which the cord 35 has to follow in the interior of the housing 11 and the confinement of the jacket portions 39 between the various parts of the housing 11 and/or the flat portions of the prongs 12 and 13 and the lid 18 further enhance this detaining capability. The presence of the cutouts 26 in the confining projections 22, on the other hand, makes it possible to use the same plug 10 either with an SPT-1 wire which has a 0.032" insulation thickness, or with an SPT-2 wire which has a 0.047" insulation thickness, inasmuch as these cutouts 26 reduce the resistance of the confining portions 22 to bending to such a level as to be able to introduce even the larger-diameter SPT-2 wire between the confining portions 22 with attendant pushing of the confining portions 22 apart, whereas the SPT-1 wire is substantially snugly received between the confining portions 22 without having to push the latter apart to any perceptible degree. Of course, the elastic yieldability of the cover or lid 18 is important to assure that the latter will exert sufficient transverse forces on the wire 35 both during the assembling operation to force the wire 35 to follow the tortuous course, and after the assembly to maintain the frictional retention of the cord 35 in the interior of the plug housing 11. Furthermore, without such yieldability, the protuberances 41 would not be able to leave the dents 34 and clear the main body 14 of the plug housing 11 during the closing of the lid 18.

Thus, the plug 10 may be connected to two types of wire, namely, SPT-1 and SPT-2, which differ substantially in size from each other. The confining projections 22 and their respective contact portions 24 and 25 bound a guide channel in which the twin-wire cord 35 is centrally received. The distance between the contact portions is such that the SPT-1 wire is received with a small clearance, whereas the SPT-2 wire is wedged in the guide channel and, in fact, the contact portions are embedded into the outer jackets 39 of the SPT-2 wire. Each twin-wire cord 35, which has a central groove between the wires at each side of the cord, is initially inserted in a vertical orientation in the plug housing so that the separating blade portions or ribs 28, 30 are received in each central groove. The ribs 28, 30 centralize and guide the twin-wire cord 35 in the receiving channel 29 so that each conductor 40 is properly penetrated by the spikes 38.

Returning now to FIG. 3 of the drawing, it may be seen therein that the lid 18 carries a nose 43 which, in the closed position of the lid 18, engages behind a stop 44 formed integrally with the main portion or body 14 of the plug housing 11 at the region of the tool-receiving space or recess 33. This engagement keeps the lid 18 in its closed position against accidental opening of the plug 10. On the other hand, this engagement can be rather easily discontinued by inserting and/or manipulating an appropriate tool in the tool-receiving space 33 in such a manner as to cause the nose 43 to clear the stop 44 during the movement of the lid 18 toward its open position.

Figure 7:
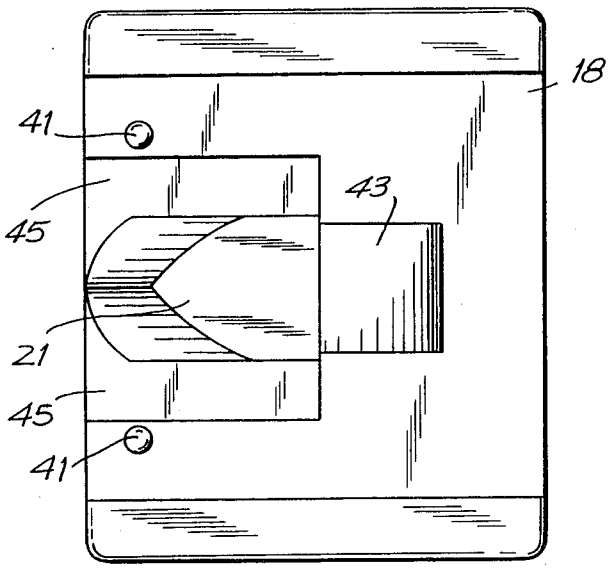
FIG. 7 is a bottom plan view of the lid of the plug housing, taken on line 7—7 of FIG. 6.

Finally, it may be ascertained from FIGS. 6 and 7 that the confining portions 22 have wedge-shaped configurations, and that the lid 18 has associated channels 45 of cooperating configurations which receive the confining portions 22 at the opposite sides of the projection 21. Obviously, the blade portions 28 and 30 serve to penetrate between the jacket portions 39 of the cord 35 and thus to retain the cord in position in the channel 29.

It will be understood that each of the elements described above, or two or more together, will also find a useful application in other types of arrangements differing from the type described above.

While the invention has been illustrated and described as embodied in an electrical plug, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range or equivalence of the claims.

What is claimed as new and desired to be protected by Letters Patent is set forth in the appended claims:

1. An electrical connector comprising a housing of an electrically insulating material bounding an input opening and a receiving channel for an end portion of an electrical cord having at least two electrical conductors surrounded by respective insulating jacket portions;

at least two electrical contact elements mounted in position in said housing and operative for establishing electrical contacts with their respective counterparts; and means for establishing electrical connections between the respective electrical conductors of said electrical cord and the associated electrical contact elements, including end penetrating elements electrically connected to the respective electrical contact elements and mounted in said housing at such locations as to project into said receiving channel and penetrate into the respective electrical conductors in the longitudinal direction of said cord during the introduction of the end portion of said cord into said receiving channel, and side penetrating elements also electrically connected to the respective electrical contact elements and so mounted in and positioned with respect to said housing as to penetrate through said jacket portions of said cord and into electrical contact with the respective electrical conductors in said input opening and substantially transversely of said cord.

2. The electrical connector as defined in claim 1, wherein said end penetrating elements and said side penetrating elements are of one piece with the respective contact elements to form respective regions thereof.

3. The electrical connector as defined in claim 1, wherein each of said side penetrating elements has at least a zone with a flat contact surface which presses against the associated electrical conductor without penetrating into the same to locally displace the electrical conductor and press the same against the oppositely located zone of the jacket portion that is juxaposed with a portion of said housing to deform such zone and increase the frictional retention of the same with respect to said housing.

4. The electrical connector as defined in claim 1, wherein each of said side penetrators has an arcuate configuration that is bent oppositely to the direction of extraction of the end portion of the cord out of the input opening to resist such extraction.

5. The electrical connector as defined in claim 1, wherein said housing includes a main body which bounds said receiving channel and partially delimits said input opening, and a lid mounted on said main body and completing the delimitation of said input opening in its mounted position, said input opening and said receiving channel following a tortuous course in said housing with a plurality of bends.

6. The electrical connector as defined in claim 5, wherein said input opening extends, at the region at which the end portion of the cord enters said housing, substantially normal to said receiving channel.

7. The electrical connector as defined in claim 6, wherein said input opening starts to slope toward said receiving channel shortly after the entry region of the cord.

8. The electrical connector as defined in claim 7, wherein the slope of said input opening terminates short of said receiving channel and said input opening has a section thereat that again extends substantially normal to said receiving channel.

9. The electrical connector as defined in claim 8, wherein said side penetrating elements are situated at said section of said input opening.

10. The electrical connector as defined in claim 1, wherein said housing includes a main body which bounds said receiving channel and partially delimits said input opening, and a lid mounted on said main body for movement along said input opening between its open and closed positions and completing the delimitation of said input opening in said closed position thereof.

11. The electrical connector as defined in claim 10, wherein one of said lid and main body has a depression and the other includes a projection that is received in said depression in said open position of said lid to temporarily maintain said lid in said open position thereof.

12. The electrical connector as defined in claim 10, wherein said main body includes a stop and said lid has a nose which engages behind said stop in said closed position of said lid to maintain said lid in said closed position.

13. The electrical connector as defined in claim 12, wherein at least said lid is elastically yieldable; and wherein said housing has a tool-receiving recess at the interface between said lid and said main body at the region of said stop and nose for the insertion of a tool thereinto for elastically deflecting said lid at said region and thus disengaging said nose from said stop for releasing said lid for movement toward said open position thereof.

14. The electrical connector as defined in claim 10, wherein said main portion of said housing includes two confining wall portions which are situated at the opposite sides of said input opening and are wedge-shaped to enclose an obtuse angle with said receiving channel.

15. The electrical connector as defined in claim 14, wherein said lid has at least one receiving space which receives said confining wall portions at least in said closed position of said lid and has a shape compatible to the wedge-shaped configurations of said confining wall portions.

16. The electrical connector as defined in claim 1, wherein said housing includes respective walls which bound said input opening and said receiving channel; and wherein at least some of such walls are elastically yieldable to aid in the retention of the end portion of the cord in said input opening and said receiving channel.

17. The electrical connector as defined in claim 16, wherein the electrical cord has a predetermined small size, and further comprising another electrical cord having a larger size; and wherein said some walls are elastically yieldable from a first position in which the smaller cord is received with a slight clearance in said receiving channel, to a second position in which the larger cord is snugly received in said receiving channel.

18. The electrical connector as defined in claim 17, wherein each electrical cord has a central longitudinally-extending groove at opposite sides thereof, and wherein the walls bounding said receiving channel include ribs at opposite sides of said receiving channel, each rib being received into a respective groove, said ribs being operative for guiding and centralizing each electrical cord along and within said receiving channel.

* * * * *